US006434858B2

(12) United States Patent
Pan

(10) Patent No.: US 6,434,858 B2
(45) Date of Patent: Aug. 20, 2002

(54) BREATHING SHOES

(76) Inventor: Wan Fu Pan, Rm. 901, No. 13, Block 5. Wanke City Garden, No. 3333 Qixin Lu, Shanghai (CN), 200110

( * ) Notice: Subject to any disclaimer, the term of this patent is extended or adjusted under 35 U.S.C. 154(b) by 0 days.

(21) Appl. No.: 09/781,759

(22) Filed: Feb. 12, 2001

(30) Foreign Application Priority Data

Jul. 27, 2000 (CN) ..... 00218598U

(51) Int. Cl.[7] ..... A43B 7/06
(52) U.S. Cl. ..... 36/3 A; 36/3 R; 36/3 B
(58) Field of Search ..... 36/3 R, 3 A, 3 B, 36/29, 35 B

(56) References Cited

U.S. PATENT DOCUMENTS 3,029,530 A * 4/1962 Eaton ..... 36/3 R
3,044,188 A * 7/1962 Evangelista ..... 36/3 R
4,817,304 A * 4/1989 Parker et al. ..... 36/29
4,843,741 A * 7/1989 Yung-Mao ..... 36/30 R
4,845,863 A * 7/1989 Yung-Mao ..... 36/28
4,942,679 A * 7/1990 Brandon ..... 36/44
4,999,932 A * 3/1991 Grim ..... 36/29
5,353,525 A * 10/1994 Grim ..... 36/29
5,515,622 A * 5/1996 Lee ..... 36/3 R
5,813,140 A * 9/1998 Obeid ..... 36/3 R
5,826,349 A * 10/1998 Goss ..... 36/29
5,953,834 A * 9/1999 Clodic ..... 36/3 A
5,979,078 A * 11/1999 McLaughlin ..... 36/29

FOREIGN PATENT DOCUMENTS

WO WO 94/09661 * 5/1994 ..... 36/3 A

* cited by examiner

*Primary Examiner*—Anthony Stashick
(74) *Attorney, Agent, or Firm*—Merchant & Gould, P.C.

(57) ABSTRACT

Breathing shoe, comprising an upper and a lining, socklining, insole and outsole, an airbag on the heel seat of the outsole. The airbag is connected with an air pipe, which extends between the inner layer and the outer layer of the upper. The portion of the air pipe on the upper is provided with punch holes such that the airbag is in communication with the interior of the shoe. The shoe produces air circulation between the interior and the exterior of the shoe for air purification and to maintain a dry and ventilated environment within the shoe.

2 Claims, 1 Drawing Sheet

BREATHING SHOES

BACKGROUND OF THE INVENTION

The present invention is related to a shoe, in particular, a kind of ventilated shoe, which is called "Breathing Shoes".

As is well known, various foot diseases could be easily caused by the heat dissipation and perspiration from feet. The interior of shoes becomes wet and muggy if they are worn for a long time, and in such condition, bacteria are especially liable to grow and reproduce. At present, many solution have been utilized to solve the said problem, for example, uppers with perforation, so-called breathable upper materials, socklining with sweat absorbent material, socklining with medicine therein, etc.

Moreover, in the current market, air cushion shoes with a closed airbag in the outsole were already developed and sold, but said airbag was only used for the enhancement of elasticity while walking; the airbag therein had no effect at all for refreshing the air within the shoe. No shoes have utilized the circulation of air between interior and exterior of shoe to solve the problem of air purification in shoes.

SUMMARY OF THE INVENTION

In view of the above problem, the present comprises a shoe, which carries out circulation of air between its interior and its exterior for air purification and for keeping the feet comfortable in a dry and ventilating environment within the shoes.

In order to achieve said purpose, the present utility model provides a shoe, which comprises an upper having an outer layer and an inner layer or lining, socklining, insole and outsole; wherein on the heel seat of the outsole is disposed an airbag. Said airbag is connected with a pipe which extends under insole to the inner layer of upper, the pipe defining several punch holes therethrough for the flow of air in and out of the airbag.

A shoe with the features of the present invention utilizes the airbag, air pipe and air punch holes to produce circulation of air between the interior and exterior of the shoe. That is, the shoe is said to "breathe". While such shoes are worn, air is continuously renewed and circulated between the interior and. exterior of the shoes, so that air within the shoes is always kept dry, clean and fresh.

DESCRIPTION OF THE DRAWINGS

In order to further the purpose of the invention and clearly identify the elements of the invention and their features, the pet invention is described in detail with regard to a preferred embodiment in following drawing.

DETAILED DESCRIPTION

Figure 1:
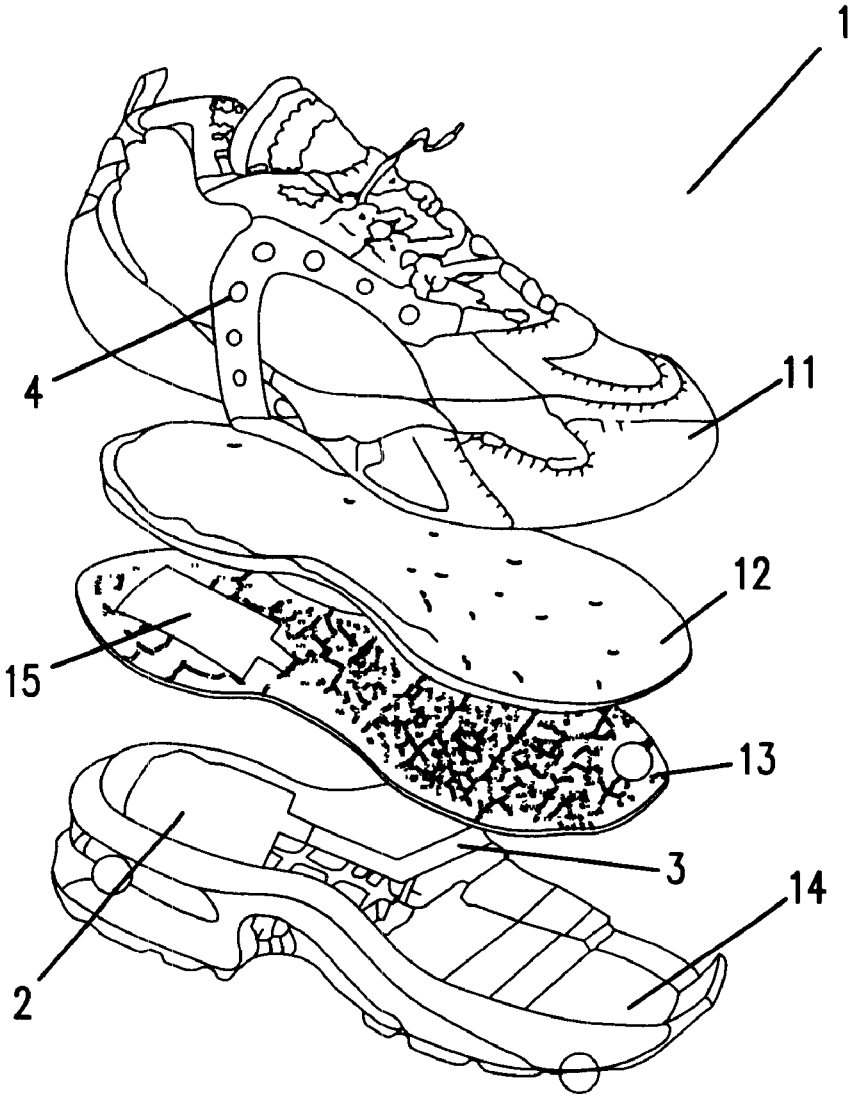
FIG. 1 is perspective view of an embodiment of a breathing shoe according to the principles of the present invention.

Shown in FIG. 1 is an embodiment of sporting shoe, which comprises an upper 11 with inner and outer layers, socklining 12, insole 13, and outsole 14. On the heel seat 18 of the outsole 14 is a resilient airbag 2, which is connected with an air pipe 3. The pipe extends along a pipe channel of in the outsole 14 and then it extends upward from the edge of the sole into the upper 11 (not shown). A portion of the air pipe 3 within the upper is positioned between the inner and outer layers of the upper 11. The air pipe 3 has punch holes 20 defined therethrough for passing air in and out of the airbag 2.

A window 15 may be provided in the heel seat 16 of insole 13, such that the airbag 2, is disposed at least partly within the window, and extends slightly over the insole in height.

As person wearing the breathing shoe places their weight on the ground, their weight at their heel applies pressure to the airbag 2. The airbag 2 is thus compressed, and air flows out of the airbag 2 through the air pipe 3 and out through the air pipe punch holes 20 into the outsole, upper and lining and thus into the interior of the shoe. This causes air to be expelled from the interior of the shoe to the exterior of the shoe through the upper punch holes 4.

When the person lifts their foot, the pressure from their heel on the airbag 2 is relieved. The airbag 2 draws air into itself from the interior of the shoe through the air pipe punch holes 20, 12 which in turn causes air to be drawn in from the exterior of the shoe to the interior of the shoe through the upper punch holes 4.

Consequently, walking or running with the breathing shoes causes the airbag to be repeatedly pressed and restored, and air in the interior of the shoes is always fresh, clean and dry. The circulation of air between the interior and the exterior of the shoes prevents disease, and also makes the foot feel comfortable.

The breathing shoes are described herein in detail with respect to a preferred embodiment, but various modifications could be made to the design without deviating from the concepts of the invention. For example, although the embodiment described herein is a sporting shoe, obviously, the concepts of the breathing shoes could be applied to any type of shoes in any upper design, shoes long as the air pipe could be provided either inside or outside of the shoes to meet design needs. Consequently, the scope of the present invention should be defined by the following claims.

What is claimed is:

1. Shoe, comprising:

an upper, comprising inner and outer layers, said upper defining punch holes therethrough, such that an interior of said shoe is in communication with an exterior of said shoe via said upper punch holes;

an outsole attached to said upper, said outsole comprising a heal seat;

an insole disposed on said outsole, said insole comprising a heel seat;

a socklining disposed on said insole;

an airbag disposed on said heel seat of said outsole;

an air pipe in communication with said airbag, at least a portion of said air pipe extending between said inner and outer layers of said upper, said air pipe defining punch holes therethrough. in said portion extending between said inner and outer layers of said upper, such that said airbag is in communication with said interior of said shoe via said air pipe and said air pipe punch holes;

whereby:

compressing said airbag causes air to be expelled from said airbag through said air pipe punch holes into said interior of said shoe, thereby causing air to be expelled from said interior of said shoe to said exterior of said shoe through said upper punch holes; and relieving compression of said airbag causes air to be drawn into said airbag through said air pipe punch holes from said interior of said shoe, thereby causing air to be drawn into said interior of said shoe from said exterior of said shoe through said upper punch holes.

2. The shoe according to claim 1, wherein said insole defines a window therethrough in said heel seat thereof, said airbag being disposed at least partially within said window.

* * * * *